US005383419A

United States Patent [19]

Stevens

[11] Patent Number: 5,383,419

[45] Date of Patent: Jan. 24, 1995

[54] WATERCRAFT TRIM SYSTEM

[76] Inventor: Ewell E. Stevens, 2450 Wooded Acres Dr., Sagle, Id. 83860

[21] Appl. No.: 143,303

[22] Filed: Oct. 26, 1993

[51] Int. Cl.[6] ..... B63B 1/22

[52] U.S. Cl. ..... 114/286

[58] Field of Search ..... 114/286, 287, 285, 126, 114/275, 276, 277, 284, 291

[56] References Cited

U.S. PATENT DOCUMENTS

| | | | |
|---|---|---|---|
| 2,576,744 | 11/1951 | Anderson . | |
| 3,001,499 | 9/1961 | Jacobs et al. . | |
| 3,177,837 | 4/1965 | Sherrill . | |
| 3,260,229 | 7/1966 | Plum . | |
| 3,326,164 | 6/1967 | Kercheval . | |
| 3,468,278 | 9/1969 | Kercheval | 114/286 |
| 3,589,323 | 6/1971 | Kercheval . | |
| 3,695,204 | 10/1972 | Bennett | 114/286 P |
| 4,261,278 | 4/1981 | Gaudin | 114/126 |
| 4,644,893 | 2/1987 | Zepp | 114/286 |
| 4,854,259 | 8/1989 | Cluett | 114/285 |
| 4,908,766 | 3/1990 | Takeuchi | 364/448 |
| 5,058,520 | 10/1991 | Fahrney | 114/285 |

FOREIGN PATENT DOCUMENTS

| | | | |
|---|---|---|---|
| 0082697 | 4/1991 | Japan | 114/286 |

*Primary Examiner*—Jesus D. Sotelo

*Attorney, Agent, or Firm*—Wells, St. John, Roberts, Gregory & Matkin

[57] ABSTRACT

A watercraft trim system having port and starboard trim flaps which mount near the stern. The trim flaps are independently operated by pneumatic operators. The pneumatic operators are governed by pressure modulators which each advantageously include a gas compressor and controllable pressure relief valve. An automatic control system is used to control the pressure modulators. The control system includes attitude sensors using optical emitter-detectors which beam across liquid-filled channels. The channels contain gas bubbles which are detected by the emitter-detectors to indicate attitude deviations.

46 Claims, 6 Drawing Sheets

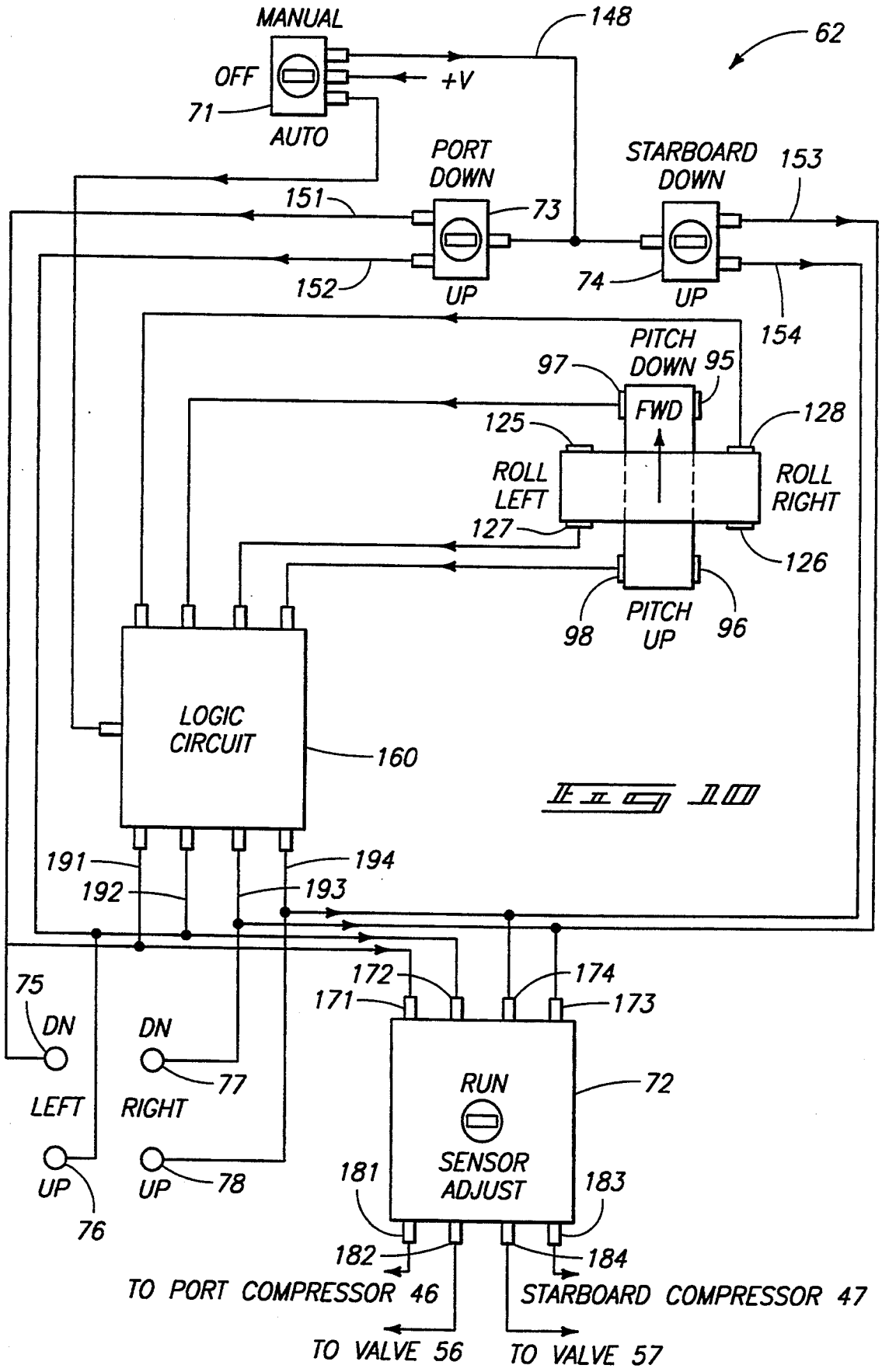
MANUAL
OFF
AUTO
+V
71
148
62
PORT DOWN
UP
151
152
73
STARBOARD DOWN
UP
153
154
74
PITCH DOWN
PITCH UP
FWD
97
95
98
96
125
127
128
126
ROLL LEFT
ROLL RIGHT
LOGIC CIRCUIT
160
191
192
193
194
75
DN
LEFT
UP
76
DN
RIGHT
UP
77
78
172
171
174
173
RUN
SENSOR ADJUST
72
181
182
183
184
TO PORT COMPRESSOR 46
STARBOARD COMPRESSOR 47
TO VALVE 56
TO VALVE 57

WATERCRAFT TRIM SYSTEM

TECHNICAL FIELD

The technical field of this invention is watercraft trim systems, particularly automatic trim systems which control roll and pitch of the watercraft.

BACKGROUND OF THE INVENTION

It has previously been recognized that boats and other watercraft operate better with adjustable trim tabs. Trim tabs are typically mounted at the stern of the vessel and are controllably extended to affect the flow of water passing about the vessel. The attitude or orientation of the watercraft is thereby affected.

Most prior trim tab systems employ hydraulic rams which extend port and starboard trim flaps. The trim flaps are extended downwardly to lower the bow of the boat. An example of such a system is shown in U.S. Pat. No. 3,695,204.

Hydraulic trim tab systems have suffered from certain limitations. Foremost is the relatively abrupt action of hydraulic trim tabs which oftentimes result in an uncomfortably abrupt change in boat attitude. Hydraulic systems also employ oil which can be messy and polluting.

Prior art boat trim systems also used a singular pump or other source of pressurized fluid. This source is then valved to the respective port and starboard trim tabs. Such an arrangement allows pressure communication between the port and starboard actuating rams even though they are intended to be of independent operation.

Thus there remains a need for an improved watercraft trim system which provides improved performance, clean operation, enhanced boat stability and smooth operation.

BRIEF DESCRIPTION OF THE DRAWINGS

One or more preferred forms of the invention are described herein with reference to the accompanying drawings. The drawings are briefly described below.

FIG. 10 is an electrical schematic diagram indicating electrical components of the control box of FIG. 3.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
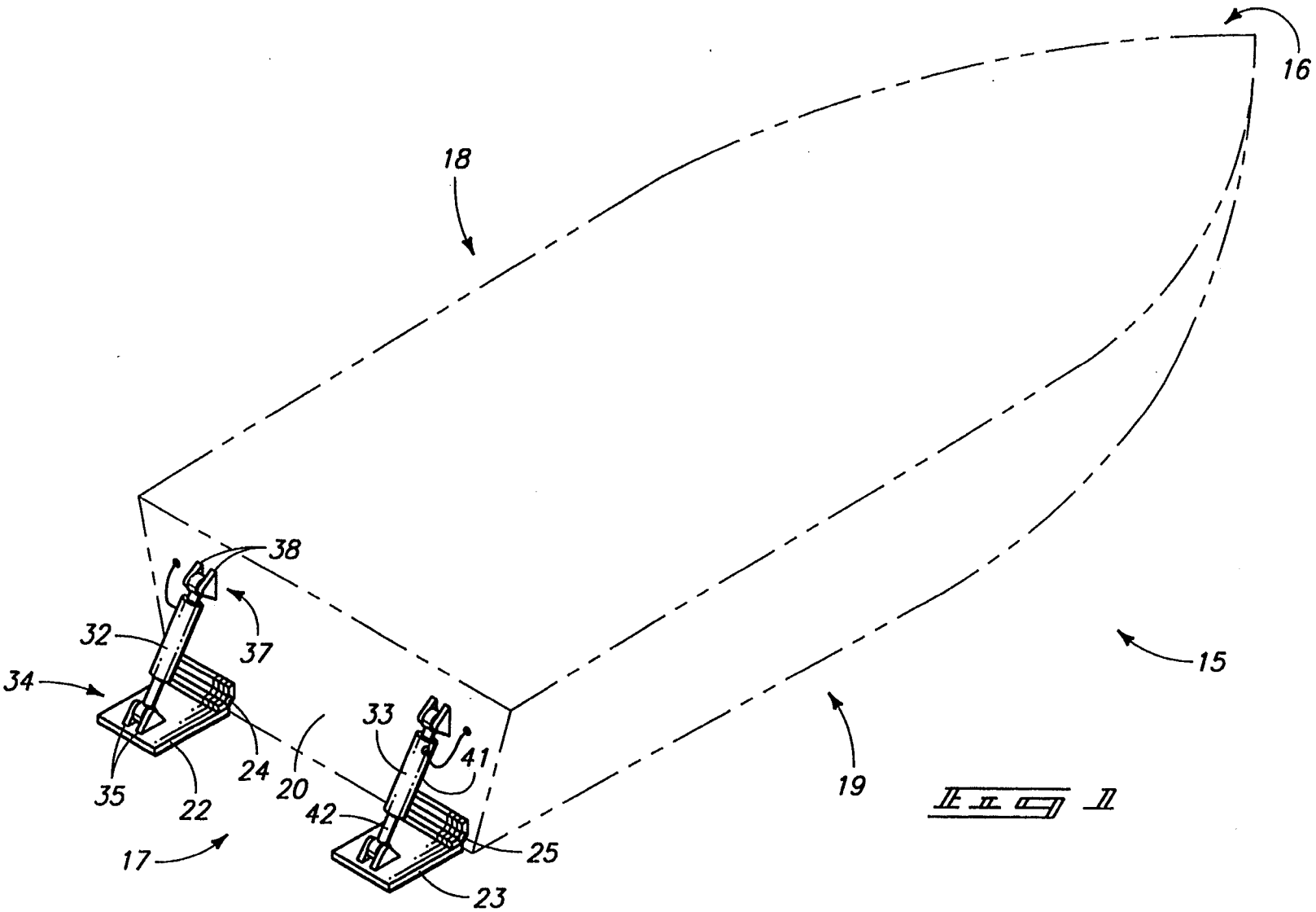
FIG. 1 is a perspective view showing outboard portions of a preferred watercraft trim system according to this invention.

FIG. 1 shows a watercraft or vessel generally referred to by the reference numeral 15. As shown the watercraft is a boat 15 having a bow 16, stern 17, port or left side 18, and starboard or right side 19. The stern is formed with a transom 20. Transom 20 mounts a pair of independently adjustable trim flaps 22 and 23. As shown, the trim flaps include a single port trim flap 22 and a single starboard trim flap 23. The port and starboard trim flaps are preferably mounted to transom 20 using port and starboard pivots or hinges 24 and 25. The pivot axes of hinges 24 and 25 are transverse to the center line of boat 15 and most preferably approximately horizontal. In the preferred embodiment, the elevational positions of the port and starboard trim flaps are complementary and symmetric with respect to the center line of the boat.

Trim flaps 22 and 23 are operated by port and starboard operators 32 and 33. Operators 32 and 33 are connected to the trim flaps at operator distal pivot connections 34. The operator distal pivot connections 34 are preferably formed by two connection lugs 35 attached to the upper side of the trim flaps. A similar construction is advantageously provided to connect the upper ends of operators 32 and 33 to transom 20. As shown, the upper ends are connected at upper or proximate end pivot joints 37 using a pair of transom connection lugs 38.

The trim flap operators 32 and 33 are preferably single acting pneumatic rams having cylinder portions 41 and movable portions 45. The movable portions include rods 42 which are connected to internal pistons 44 (see FIG. 2). Compressed gas is supplied through an extension gas supply fitting 43. The port and starboard operators can alternatively be double-acting rams, or single-acting rams which are spring biased into a retracted position.

Figure 2:
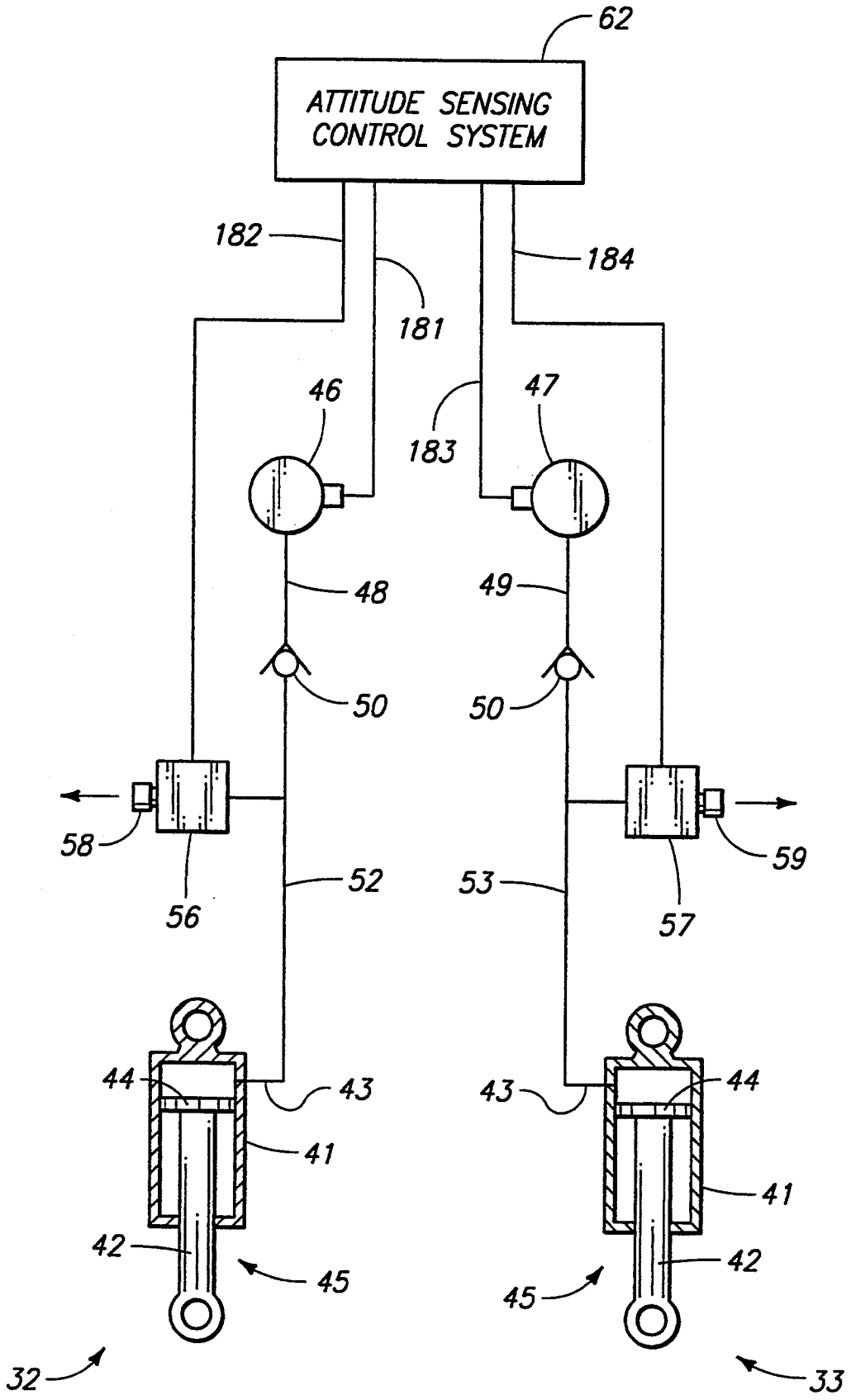
FIG. 2 is a diagrammatic view showing the pneumatic components of the trim system of FIG. 1 and their interface with the control system.

FIG. 2 shows the pneumatic components used to modulate operators 32 and 33 into desired positions. The port and starboard trim flaps are operated using independent pneumatic channels each having its own separate compressed gas supply. The compressed gas supply is advantageously provided using independent port and starboard gas compressors 46 and 47. Pressurized gas, such as air, is supplied through compressor outflow lines 48 and 49.

The output from compressors 46 and 47 are connected to the operators 32 and 33 via outflow lines 48 and 49, and through port and starboard pressure supply lines 52 and 53, respectively. Check valves 50 are interposed between lines 48 and 52, and between lines 49 and 53. These check valves allow pressurized gas to flow from compressors 46 and 47 towards pneumatic rams 32 and 33. However, check valves 50 prevent backflow of compressed gas from operators 32 and 33 into compressors 46 and 47.

The pressure supply lines 52 and 53 for port and starboard operators 32 and 33 are also in fluid communication with port and starboard controllable pressure relief valves 56 and 57. Pressure relief valves 56 and 57 are provided with vents 58 and 59 which allow pressure to be relieved and the resultant pressure within lines 52 and 53 to be reduced. Valves 56 and 57 are preferably electrical solenoid operated valves. The valves are preferably two-way valves which are normally closed and electrically activated to relieve pressure in the supply lines 52 and 53.

FIG. 2 also shows that the invention further includes an attitude sensing control system 62. Attitude sensing control system includes an attitude sensing subsystem 63 and an electronic control system 64 (see FIG. 3).

Figure 3:
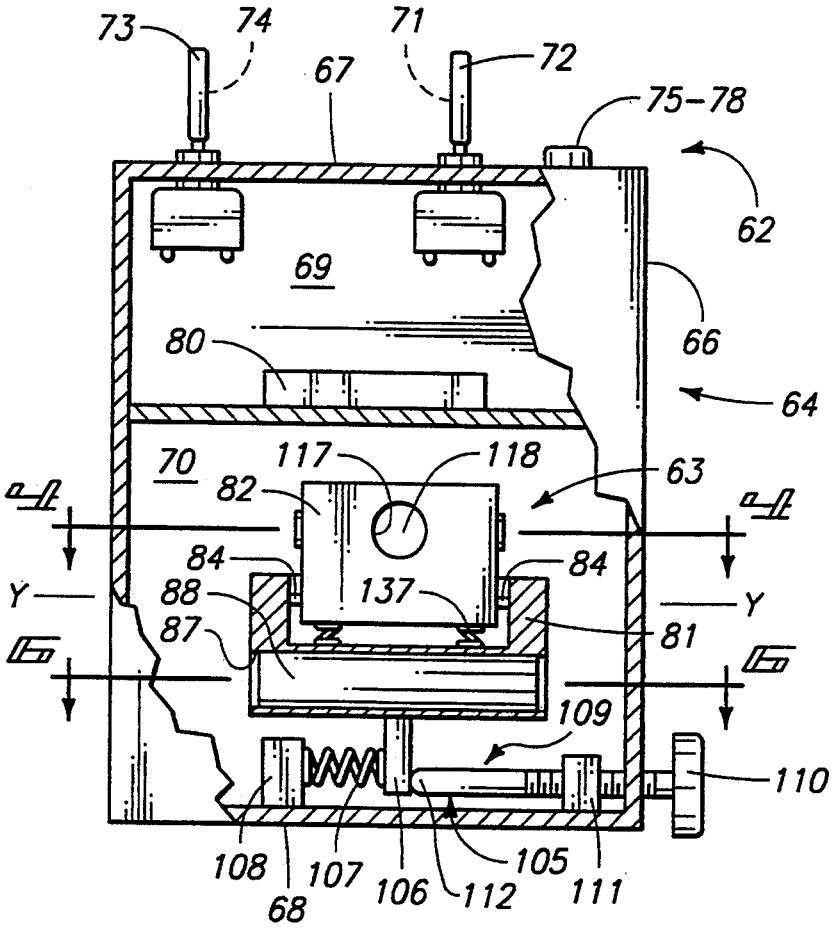
FIG. 3 is a side elevational view of a preferred control box with portions broken away and shown in cross-section.
Figure 4:
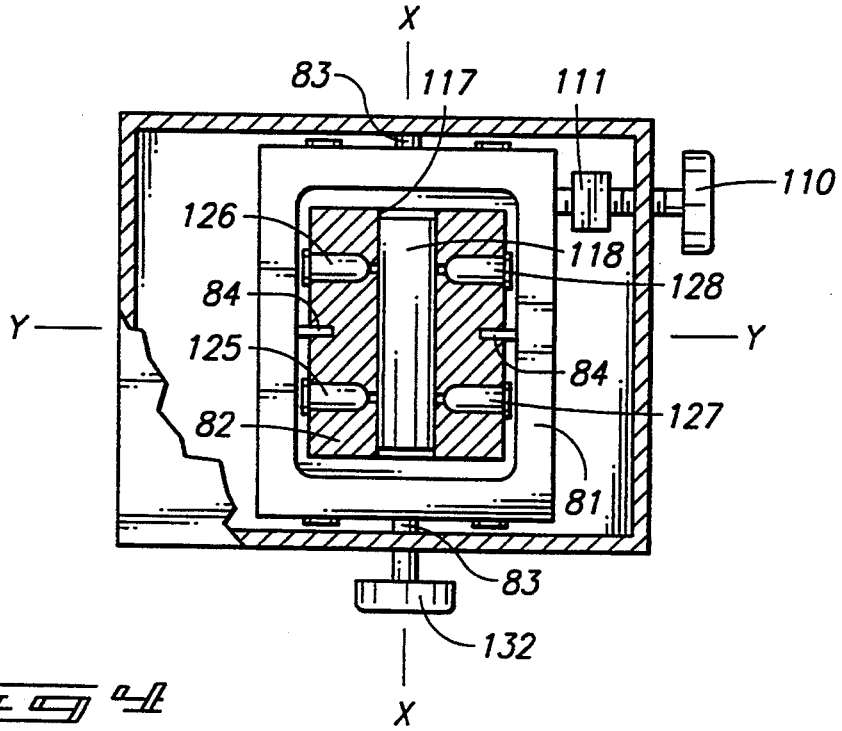
FIG. 4 is a top view of the control box of FIG. 3 with portions broken away and shown in cross-section.
Figure 5:
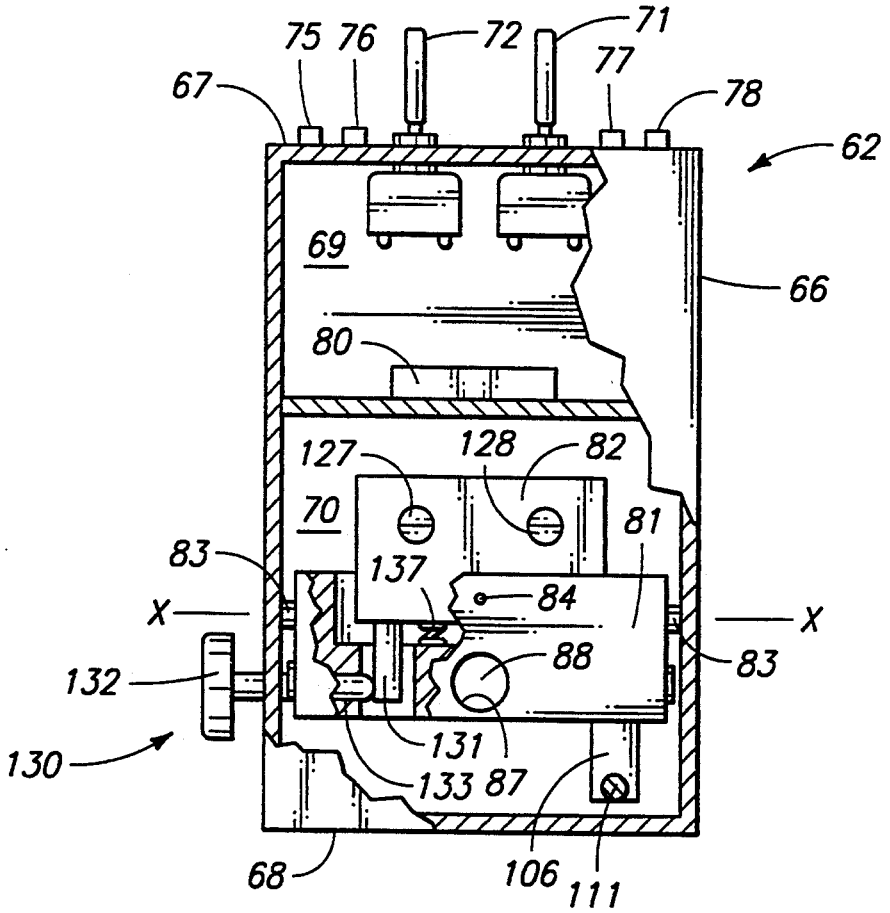
FIG. 5 is an end view of the control box of FIG. 3 with portions broken away and shown in cross-section.

The attitude sensing system 63 is illustrated in FIGS. 3-7. FIG. 3 shows a broken-away elevational view depicting principle components of the attitude sensing control system. The control system includes a control system housing or box 66 which is preferably mounted at a convenient location for the boat operator to manipulate. Box 66 has a top surface 67 and a bottom surface 68. The orientation of the control system box is significant because it mounts an attitude sensing mechanism which must be oriented in a neutral position associated with the desired attitude of the boat when cruising. An upper portion 69 of box 66 is advantageously used to mount four electrical switches 71-74, indicator lights 75-78, and an electronics module 80. A lower compartment 70 is advantageously used to mount the attitude sensing subsystem 63.

Attitude sensing system 63 includes a first gimbal frame piece 81 and a second gimbal frame piece 82. First gimbal frame piece 81 is pivotally connected to box 66 at first gimbal pivots 83. Pivots 83 define a first pivot axis X—X illustrated in FIG. 4. The second gimbal frame piece 82 is pivotally mounted to first gimbal frame piece 81 at second gimbal pivots 84. Gimbal pivots 84 define a second pivot axis Y—Y. Pivot axis Y—Y is preferably in a bearing orientation which is 90 degrees of arc or perpendicular to pivot axis X—X. Pivot axes X—X and Y—Y need not lie in the same elevational plane.

The first gimbal frame piece 81 is provided with a sensing vial mounting chamber 87. Mounted within chamber 87 is an enclosed sensing vial 88 shown in isolation in FIG. 7. Sensing vial 88 includes a tubular vial member 89 having end closures 90. The internal bubble chamber 91 is predominantly filled with a suitable liquid such as isopropyl alcohol. A bubble 92 of gas, for example air, is left within chamber 91. Bubble 92 moves within chamber 91 in response to rolling or pitching of boat 15. The curvature of chamber 91 has been exaggerated for purposes of illustration.

Figure 6:
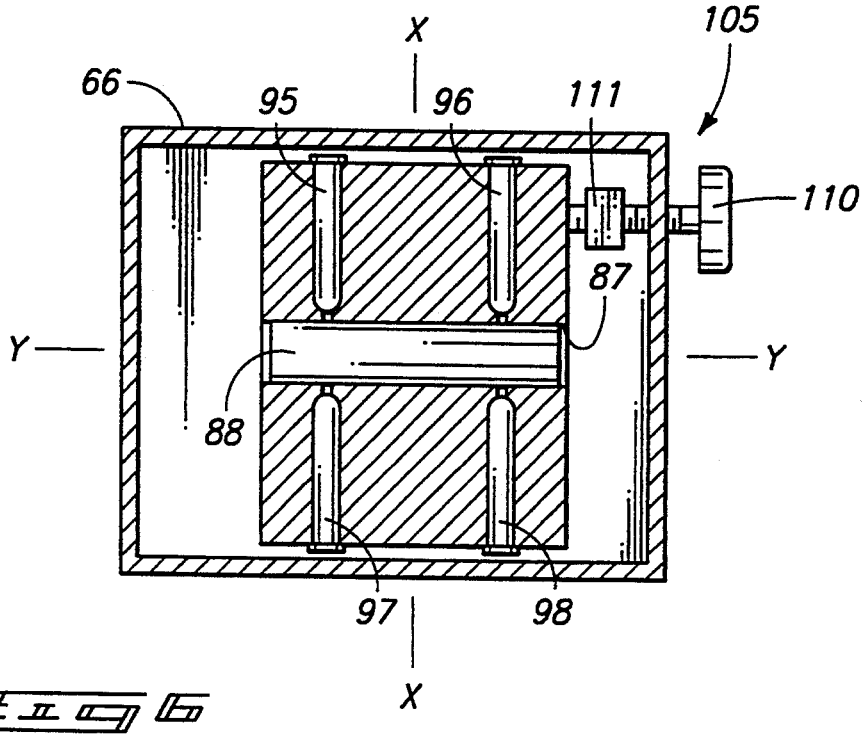
FIG. 6 is a sectional view taken along line 6—6 of FIG. 3.
Figure 7:
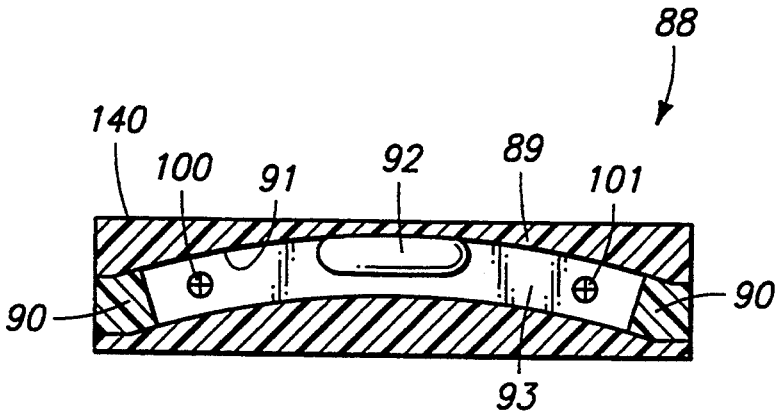
FIG. 7 is a longitudinal sectional view of a first form of sensing vial used in the control box of FIG. 3.

First gimbal frame piece 81 is also preferably adapted to mount optical emitter-detector pairs adjacent to the sensing vial mounting chamber 87. FIG. 6 shows this is advantageously accomplished by forming passages which mount a fore emitter 95, aft emitter 96, fore detector 97, and aft detector 98. Fore emitter 95 produces an optical beam, such as an infrared beam, which is beamed across the sensing vial 88 and detected by the fore detector 97. Similarly, aft emitter 96 produces an optical beam such as an infrared beam which is beamed across the sensing vial 88 and detected by the aft detector 98. The amount of beam detected by detectors 97 and 98 is different depending upon whether bubble 92 is positioned intermediate the beam paths or within the beam path. This difference in transmission between the emitters and detectors provides an indication of the attitude of boat 15 in the fore and aft pitch directions.

The angular position of first gimbal frame piece 81 relative to box 66 and the vessel is preferably made adjustable by a first or pitch sensor adjustment mechanism 105. As shown, pitch adjustment mechanism 105 includes a contact lug 106 which depends or otherwise extends from first gimbal frame piece 81. A biasing force is applied against the first gimbal frame piece, such as at lug 106 by using a spring 107. Spring 107 is supported between contact lug 106 and spring mounting block 108. Adjustment mechanism 105 also preferably includes a suitable, adjustable displacement member 109 which is shown in the form of an advancing thumb screw 110. Thumb screw 110 is threaded into a displacement member mount 111 fixed to the bottom of housing 66. A contact end 112 of thumb screw 110 bears against contact lug 106 of first gimbal frame piece 81. By threading thumb screw 110, the angular position of piece 81 is adjusted about pivot axis X—X. The biasing force provided by spring 107 prevents jitter about axis X—X. This mechanism allows the neutral position of pitch sensing vial 88 to be adjusted relative to the boat. This is typically done once when the system is set up and remains without need of further adjustment unless the captain wishes to define a new desired attitude for the boat, or if the box or mount is somehow modified.

Second gimbal frame piece 82 is also preferably provided with a sensing vial mounting chamber 117. Mounting chamber 117 receives a roll direction sensing vial 118 which is constructed the same as vial 88, shown and described above in connection with FIG. 7. Both sensing vials 118 and 88 have approximately 2.5° of arc along the length of the tubular chamber so as to provide movement of bubble 92 approximately plus or minus 1.25° of arc in either direction from the neutral position, until the bubble intercepts beams 100 and 101.

The second gimbal frame piece 82 also supports port and starboard emitter-detector pairs 125-128. Port emitter 125 beams across the roll sensing vial 118 and is detected by the port detector 127. Similarly, starboard emitter 126 beams across the sensing vial at the opposing end and is detected by starboard detector 128.

Second gimbal frame piece 82 is mounted relative to gimbal frame piece 81 in a manner which allows angular adjustment about the pivot axis Y—Y, defined by pivots 84. The roll sensor adjustment mechanism 130 includes a contact lug 131 which depends or otherwise extends from second gimbal frame piece 82. Contact lug 131 is contacted by a displacement member 132 which is preferably in the form of a threaded thumb screw. Thumb screw 132 is threadably received in a corresponding aperture 133 formed in first gimbal frame piece 81. The displacing action of advanced contact by thumb screw 132 is preferably resisted by biasing springs 137. The position of roll sensing vial 118 relative to boat 15 is adjusted using thumb screw 132. This adjustment is typically made when the system is initially set up and is used to zero the bubble to a neutral location when the boat is in a desired orientation with regard to roll.

Figure 8:
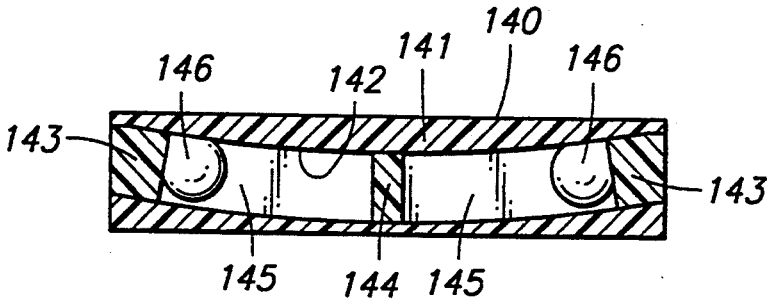
FIG. 8 is a longitudinal sectional view of a second form of sensing vial used in the control box of FIG. 3.
Figure 9:
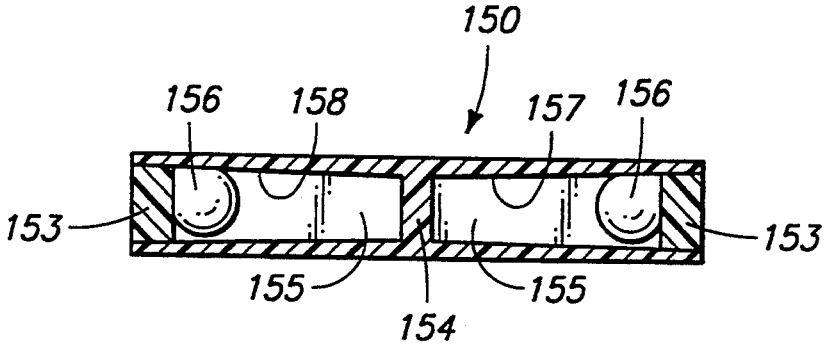
FIG. 9 is a longitudinal sectional view of a third form of sensing vial used in the control box of FIG. 3.

FIGS. 8 and 9 show alternative constructions for the sensing vials 88 and 118. Sensing vial 140 of FIG. 8 includes an arced cylindrical channel which bears a curvature defining the desired range of angular travel of the watercraft between activation of the trim flaps. As shown, the curvature is approximately plus or minus 1.25° of arc. Vial 140 has a tubular part 141. The tubular part includes the curved channel 142 and end closures 143 which confine the internal chamber. A central partition 144 divides the internal chamber into two compartments, each of which is filled with a suitable liquid 145 and a gaseous bubble 146. In this embodiment, the bubbles are normally in a position where the optical beam passes through the bubble. Sufficient angular movement, either pitching or rolling, will cause one or the other of the bubbles to be dislocated. The dislocation of the bubble thus affects the transmission of the optical beam between the emitter and detector. This serves to provide an indication of roll or pitch variation beyond the acceptable variation, such as plus or minus 1.25° arc.

FIG. 9 shows a further alternative vial 150. Vial 150 has two frustoconically shaped chambers 157 and 158. Each chamber 157 and 158 is filled with liquid 155 and a gaseous bubble 156. The conical tapering of the interior walls of chambers 157 and 158 causes the bubbles to move to the extreme ends, in position with the optical beams. End closures 153 seal the conical chambers. A preferred construction uses an inclusive angle of 2.5° between the opposing sides of the frustoconically shaped chambers. A barrier wall 154 divides chambers 157 and 158.

The angular range of the sensing vials can be adjusted by rotating the vials within their respective receiving channels. Angularly displacing the vials from a position wherein the curvature is in a vertical plane reduces the amount roll or pitch needed to achieve bubble movement. Thus the range or sensitivity can be manually adjusted by inclined positioning of the vials.

FIG. 10 shows a preferred electronic configuration for the electronic control system 64. Voltage is supplied to the first or primary control switch 71. First control switch 71 is a three-position switch having two output terminals and allowing an off mode, manual mode, or automatic mode. When switch 71 is in the off mode then neither the manual or automatic outputs are activated. When switch 71 is in the manual mode, current flows to the port and starboard adjustment switches 73 and 74 via conductor 148. When switch 71 is in the automatic mode, the logic circuit 160 is activated enabling automatic roll and pitch adjustment to maintain a desired boat attitude.

The manual adjustment switches 73 and 74 are three position switches which are biased into the neutral or off central position. Each manual adjustment switch has two outputs.

The first output 151 of port or left manual adjustment switch 73 is connected to a down indicator lamp 75. First output 151 is also connected to input terminal 171 of second switch 72. Second switch 72 is a gauged four pole, two position switch which is either closed or open. In the run position the four input terminals 171–174 are connected to their respective output terminals 181–184. In the sensor adjust position the four switch poles are open and the outputs 181–184 are inactivated. When the manual switch first or down output 151 is active and the second switch 72 is closed, then the port compressor 46 is activated and the pressure is increased in supply 52. This causes the port operator 32 and trim flap 22 to extend.

In a similar construction, the manual adjustment switch 73 also has a second or up output 152 which is connected to the port trim flap up indicator lamp 76. Second output 152 is also connected to input terminal 172 of second switch 72. When switch 72 is closed and switch 73 activates the second output 152, then the left or port valve 56 receives an active signal from output terminal 182 and is activated to open. The opening of valve 56 reduces the pressure to operator 32 to thereby effectively retract the port trim flap 22.

The starboard or right manual adjustment switch 74 is similarly connected to allow manual extension or retraction of the starboard operator 33. The first or down output terminal 153 of switch 74 is connected to the third input terminal 173 of switch 72. Closure of switch 72 causes input terminal 173 to be connected to third output terminal 183 to activate the starboard compressor 47. This in turn causes extension of starboard operator 33. Second or up output terminal 154 of switch 74 is connected to the fourth input terminal 174 of switch 72. Closure of switch 72 causes input terminal 174 to be connected to fourth output terminal 184 to activate relief valve 57. This decreases the pressure in line 53 and effectively retracts starboard operator 33.

During use the operator of the boat switches first switch 71 to manual and second switch 72 to the run or closed position. The boat is under power and the manual adjustment switches are moved up or down by the operator to adjust the attitude of the boat, with respect to both pitch and roll. When the desired attitude is achieved, the operator switches the first switch to the automatic operation position which then activates the logic circuit 160 and deactivates the manual adjustment switches 73 and 74.

When the system is first installed it is also necessary to manually adjust the pitch adjustment mechanism 105 and the roll adjustment mechanism 130. This is accomplished by first powering the boat to a desired speed and attitude by manually adjusting the trim flaps as explained above. The operator then moves switch 72 into the open or sensor adjust position in which the outputs 181–184 are inactivated. The operator then adjusts the mechanisms 105 and 130 so that the sensor bubbles are in neutral positions at the desired boat attitude. The second switch 72 is then switched back to the run position. If any additional manual adjustment is desired then switches 73 and 74 are used to further adjust the attitude of the boat. Thereafter the first switch is moved into the automatic position and the logic circuit functions to maintain the boat attitude which has been selected by manual adjustment.

Logic circuit 160 is electrically connected to optical detectors 97, 98, 127, and 128. Depending upon the light transmission characteristics present between the associated emitter-detector pairs, this signal is relatively higher or lower when the boat is displaced from the neutral position determined by adjustment of pitch and roll adjustment mechanisms 105 and 130. Logic circuit 160 interprets the output signals from the detectors and utilizes their conditions to provide output signals 191–194 which are conducted to input terminals 171–174 of second switch 72. The control signals from logic circuit outputs 191–194 operate the compressors 46 and 47 and the relief valves 56 and 57 to achieve pitch and roll attitude which is between the angular range of the sensor vials 88 and 118, such as variance within 2.5° of arc.

In compliance with the statute, the invention has been described in language necessarily limited in its ability to properly convey the conceptual nature of the invention. Because of this inherent limitation of language, it must be understood that the invention is not necessarily limited to the specific features described, since the means herein disclosed comprise merely preferred forms of putting the invention into effect. The invention is, therefore, claimed in any of its forms or modifications within the proper scope of the appended claims appropriately interpreted in accordance with the doctrine of equivalents.

I claim:

1. A watercraft trim system for mounting upon a vessel having a hull with a stern, bow, port side and starboard side, comprising:

a first trim flap mounted adjacent the stern of the vessel toward the starboard side;

a second trim flap mounted adjacent the stern of the vessel toward the port side;

a first pneumatic operator connected to the first trim flap and the vessel to allow adjustable positioning of the first trim flap relative to the hull;

a second pneumatic operator connected to the second trim flap and the vessel to allow adjustable positioning of the second trim flap relative to the hull;

a first pressure modulator in fluid communication with the first pneumatic operator for controllably varying pressure supplied to the first pneumatic operator; said first pressure modulator comprising a first pressure source connected to controllably supply pressurized gas to the first pneumatic operator, and a controllable first pressure relief valve for controllably relieving pressure supplied to the first pneumatic operator;

a second pressure modulator in fluid communication with the second pneumatic operator for controllably varying pressure supplied to the second pneumatic operator; said second pressure modulator comprising a second pressure source connected to controllably supply pressurized gas to the second pneumatic operator, and a controllable second pressure relief valve for controllably relieving pressure supplied to the second pneumatic operator;

an automatic control system which senses to provide information indicating attitude of the vessel and controls the first and second pressure modulators to automatically adjust attitude of the vessel when moving through the water.

2. A watercraft trim system according to claim 1 wherein:

said first pressure modulator comprises:

a first gas compressor forming at least part of said first pressure source;

said second pressure modulator comprises:

a second gas compressor forming at least part of said second pressure source.

3. A watercraft trim system according to claim 1 wherein:

said first pressure modulator further comprises:

a first check valve connected to prevent fluid flow from the first pneumatic operator toward the first pressure source; and said second pressure modulator further comprises:

a second check valve connected to prevent fluid flow from the first pneumatic operator toward the first pressure source.

4. A watercraft trim system according to claim 1 wherein:

said first pressure modulator comprises:

a first gas compressor forming at least part of said first pressure source;

a first check valve connected to prevent fluid flow from the first pneumatic operator toward the first gas compressor; and said second pressure modulator comprises:

a second gas compressor forming at least part of said second pressure source;

a second check valve connected to prevent fluid flow from the first pneumatic operator toward the first gas compressor.

5. A watercraft trim system according to claim 1 wherein said automatic control system includes:

a first sensing chamber containing a liquid and a first gas bubble which moves within the liquid in response to changes in the attitude of the vessel;

at least one first emitter-detector pair mounted to beam across the first sensing chamber to detect changes in the first gas bubble;

a second sensing chamber containing a liquid and a second gas bubble which moves within the liquid in response to changes in the attitude of the vessel;

at least one second emitter-detector pair mounted to beam across the second sensing chamber to detect changes in the second gas bubble.

6. A watercraft trim system according to claim 5 wherein the first and second sensing chambers are oriented along intersecting bearing directions.

7. A watercraft trim system according to claim 5 wherein the first and second sensing chambers are oriented along approximately perpendicular bearing directions.

8. A watercraft trim system according to claim 5 wherein the first and second sensing chambers are mounted upon a gimbal support mechanism which allows adjustment of the sensing chambers relative to the vessel.

9. A watercraft trim system according to claim 5 wherein the first and second sensing chambers are mounted upon a gimbal support mechanism which allows adjustment of the sensing chambers relative to the vessel; said gimbal support mechanism including biasing means.

10. A watercraft trim system according to claim 5 wherein said first and second sensing chambers are provided with a single bubble of gas.

11. A watercraft trim system according to claim 5 wherein there are at least two of said first and second sensing chambers; complementary first sensing chambers and complementary second sensing chambers being angled relative to one another to allow sensing for oppositely directed changes in attitude of the vessel.

12. A watercraft trim system for mounting upon a vessel having a hull with a stern, bow, port side and starboard side, comprising:

a first trim flap mounted adjacent the stern of the vessel toward the starboard side;

a second trim flap mounted adjacent the stern of the vessel toward the port side;

a first pneumatic operator connected to the first trim flap and the vessel to allow adjustable positioning of the first trim flap relative to the hull;

a second pneumatic operator connected to the second trim flap and the vessel to allow adjustable positioning of the second trim flap relative to the hull;

a first gas compressor connected to supply pressurized gas to the first pneumatic operator;

a second gas compressor connected to supply pressurized gas to the second pneumatic operator;

a controllable first pressure relief valve for relieving pressure from the first pneumatic operator;

a controllable second pressure relief valve for relieving pressure from the second pneumatic operator;

an automatic control system which senses to provide information indicating attitude of the vessel and controls said gas compressors or said pressure relief valves to automatically adjust attitude of the vessel when moving through the water; said automatic control system including:

a first sensing chamber containing a liquid and a first gas bubble which moves within the liquid in response to changes in the attitude of the vessel;

at least one first emitter-detector pair mounted to beam across the first sensing chamber to detect changes in the first gas bubble;

a second sensing chamber containing a liquid and a second gas bubble which moves within the liquid in response to changes in the attitude of the vessel;

at least one second emitter-detector pair mounted to beam across the second sensing chamber to detect changes in the second gas bubble.

13. A watercraft trim system according to claim 12 and further comprising:

a first check valve connected to prevent fluid flow from the first pneumatic operator toward the first gas compressor;

a second check valve connected to prevent fluid flow from the second pneumatic operator toward the second gas compressor.

14. A watercraft trim system according to claim 12 wherein the first and second sensing chambers are oriented along intersecting bearing directions.

15. A watercraft trim system according to claim 12 wherein the first and second sensing chambers are oriented along approximately perpendicular bearing directions.

16. A watercraft trim system according to claim 12 wherein the first and second sensing chambers are mounted upon a gimbal support mechanism which allows adjustment of the sensing chambers relative to the vessel.

17. A watercraft trim system according to claim 12 wherein the first and second sensing chambers are mounted upon a gimbal support mechanism which allows adjustment of the sensing chambers relative to the vessel; said gimbal support mechanism including biasing means.

18. A watercraft trim system according to claim 12 wherein said first and second sensing chambers are provided with a single bubble of gas.

19. A watercraft trim system according to claim 12 wherein there are at least two of said first and second sensing chambers; complementary first sensing chambers and complementary second sensing chambers being angled relative to one another to allow sensing for oppositely directed changes in attitude of the vessel.

20. An automatic control system for watercraft trim systems used upon a vessel, comprising:

a first sensing chamber containing a liquid and a first gas bubble which moves within the liquid in response to changes in the attitude of the vessel;

at least one first emitter-detector pair mounted to beam across the first sensing chamber to detect changes in the first gas bubble;

a second sensing chamber containing a liquid and a second gas bubble which moves within the liquid in response to changes in the attitude of the vessel;

at least one second emitter-detector pair mounted to beam across the second sensing chamber to detect changes in the second gas bubble.

21. An automatic control system for watercraft trim systems according to claim 20 wherein the first and second sensing chambers are oriented along intersecting bearing directions.

22. An automatic control system for watercraft trim systems according to claim 20 wherein the first and second sensing chambers are oriented along approximately perpendicular bearing directions.

23. An automatic control system for watercraft trim systems according to claim 20 wherein the first and second sensing chambers are mounted upon a gimbal support mechanism which allows adjustment of the sensing chambers relative to the vessel.

24. An automatic control system for watercraft trim systems according to claim 20 wherein the first and second sensing chambers are mounted upon a gimbal support mechanism which allows adjustment of the sensing chambers relative to the vessel; said gimbal support mechanism including biasing means.

25. An automatic control system for watercraft trim systems according to claim 20 wherein said first and second sensing chambers are provided with a single bubble of gas.

26. An automatic control system for watercraft trim systems according to claim 20 wherein there are at least two of said first and second sensing chambers; complementary first sensing chambers and complementary second sensing chambers being angled relative to one another to allow sensing for oppositely directed changes in attitude of the vessel.

27. A watercraft trim system for mounting upon a vessel having a hull with a stern, bow, port side and starboard side, comprising:

a trim flap mounted upon the hull;

a pneumatic operator connected to the trim flap and the vessel to allow adjustable positioning of the trim flap relative to the hull;

a pressure modulator in fluid communication with the pneumatic operator for controllably varying pressure supplied to the pneumatic operator; said pressure modulator comprising a pressure source connected to controllably supply pressurized gas to the pneumatic operator, and a controllable pressure relief valve for controllably relieving pressure supplied to the pneumatic operator;

an automatic control system which senses to provide information indicating attitude of the vessel and controls the pressure modulator to automatically adjust attitude of the vessel when moving through the water.

28. A watercraft trim system according to claim 27 wherein said pressure modulator comprises a gas compressor forming at least part of said pressure source.

29. A watercraft trim system according to claim 27 wherein said pressure modulator further comprises a check valve connected to prevent fluid flow from the pneumatic operator toward the pressure source.

30. A watercraft trim system according to claim 27 wherein said pressure modulator comprises:

a gas compressor forming at least part of said pressure source;

a check valve connected to prevent fluid flow from the pneumatic operator toward the gas compressor.

31. A watercraft trim system according to claim 27 wherein said automatic control system includes:

a sensing chamber containing a liquid and a gas bubble which moves within the liquid in response to changes in the attitude of the vessel;

at least one first emitter-detector pair mounted to beam across the sensing chamber to detect changes in the gas bubble.

32. A watercraft trim system according to claim 27 wherein said automatic control system includes:

a first sensing chamber containing a liquid and a first gas bubble which moves within the liquid in response to changes in the attitude of the vessel;

at least one first emitter-detector pair mounted to beam across the first sensing chamber to detect changes in the first gas bubble;

a second sensing chamber containing a liquid and a second gas bubble which moves within the liquid in response to changes in the attitude of the vessel;

at least one second emitter-detector pair mounted to beam across the second sensing chamber to detect changes in the second gas bubble.

33. A watercraft trim system according to claim 32 wherein the first and second sensing chambers are oriented along intersecting bearing directions.

34. A watercraft trim system according to claim 32 wherein the first and second sensing chambers are oriented along approximately perpendicular bearing directions.

35. A watercraft trim system according to claim 32 wherein the first and second sensing chambers are mounted upon a gimbal support mechanism which allows adjustment of the sensing chambers relative to the vessel.

36. A watercraft trim system according to claim 32 wherein the first and second sensing chambers are mounted upon a gimbal support mechanism which allows adjustment of the sensing chambers relative to the vessel; said gimbal support mechanism including biasing means.

37. A watercraft trim system according to claim 32 wherein said first and second sensing chambers are provided with a single bubble of gas.

38. A watercraft trim system according to claim 32 wherein there are at least two of said first and second sensing chambers; complementary first sensing chambers and complementary second sensing chambers being angled relative to one another to allow sensing for oppositely directed changes in attitude of the vessel.

39. A watercraft trim system for mounting upon a vessel having a hull with a stern, bow, port side and starboard side, comprising:

a first trim flap mounted adjacent the stern of the vessel toward the starboard side;

a second trim flap mounted adjacent the stern of the vessel toward the port side;

a first pneumatic operator which is connected to the first trim flap and the vessel and is extendible and retractable to allow adjustable positioning of the first trim flap relative to the hull;

a second pneumatic operator which is connected to the second trim flap and the vessel and is extendible and retractable to allow adjustable positioning of the second trim flap relative to the hull;

a first pressure modulator in fluid communication with the first pneumatic operator for controllably operating the first pneumatic operator by varying pressure supplied to the first pneumatic operator;

a second pressure modulator in fluid communication with the second pneumatic operator for controllably operating the second pneumatic operator by varying pressure supplied to the second pneumatic operator;

an automatic control system which senses to provide information indicating attitude of the vessel and controls the first and second pressure modulators to automatically adjust attitude of the vessel when moving through the water.

40. A watercraft trim system according to claim 39 wherein said automatic control system includes:

a first sensing chamber containing a liquid and a first gas bubble which moves within the liquid in response to changes in the attitude of the vessel;

at least one first emitter-detector pair mounted to beam across the first sensing chamber to detect changes in the first gas bubble;

a second sensing chamber containing a liquid and a second gas bubble which moves within the liquid in response to changes in the attitude of the vessel;

at least one second emitter-detector pair mounted to beam across the second sensing chamber to detect changes in the second gas bubble.

41. A watercraft trim system according to claim 39 wherein the first and second sensing chambers are oriented along intersecting bearing directions.

42. A watercraft trim system according to claim 39 wherein the first and second sensing chambers are oriented along approximately perpendicular bearing directions.

43. A watercraft trim system according to claim 39 wherein the first and second sensing chambers are mounted upon a gimbal support mechanism which allows adjustment of the sensing chambers relative to the vessel.

44. A watercraft trim system according to claim 39 wherein the first and second sensing chambers are mounted upon a gimbal support mechanism which allows adjustment of the sensing chambers relative to the vessel; said gimbal support mechanism including biasing means.

45. A watercraft trim system according to claim 39 wherein said first and second sensing chambers are provided with a single bubble of gas.

46. A watercraft trim system according to claim 39 wherein there are at least two of said first and second sensing chambers; complementary first sensing chambers and complementary second sensing chambers being angled relative to one another to allow sensing for oppositely directed changes in attitude of the vessel.

* * * * *